US011398123B1

(12) United States Patent
Mars et al.

(10) Patent No.: US 11,398,123 B1
(45) Date of Patent: Jul. 26, 2022

(54) METHODS AND APPARATUS FOR FACILITATING OPERATION OF CONTROL ACCESS SYSTEMS

(71) Applicant: Proxy, Inc., San Francisco, CA (US)

(72) Inventors: Denis Mars, San Francisco, CA (US); Simon Ratner, San Francisco, CA (US); William Papper, San Francisco, CA (US)

(73) Assignee: Proxy, Inc., San Francisco, CA (US)

( * ) Notice: Subject to any disclaimer, the term of this patent is extended or adjusted under 35 U.S.C. 154(b) by 0 days.

(21) Appl. No.: 17/068,314

(22) Filed: Oct. 12, 2020

Related U.S. Application Data

(60) Provisional application No. 62/913,599, filed on Oct. 10, 2019.

(51) Int. Cl.

| | |
|---|---|
| ***G07C 9/29*** | (2020.01) |
| ***G07C 9/27*** | (2020.01) |
| ***G07C 9/21*** | (2020.01) |
| ***G07C 9/28*** | (2020.01) |

(52) U.S. Cl.
CPC ..... *G07C 9/29* (2020.01); *G07C 9/21* (2020.01); *G07C 9/27* (2020.01); *G07C 9/28* (2020.01)

(58) Field of Classification Search
CPC ... G07C 9/29; G07C 9/21; G07C 9/27; G07C 9/28; G07C 9/38
See application file for complete search history.

(56) References Cited

U.S. PATENT DOCUMENTS

| | | | | |
|---|---|---|---|---|
| 9,666,000 | B1 * | 5/2017 | Schoenfelder | G07C 9/257 |
| 9,691,206 | B2 * | 6/2017 | Kusens | G07C 9/00817 |
| 10,380,814 | B1 * | 8/2019 | Mathiesen | G07C 9/253 |
| 10,692,312 | B1 * | 6/2020 | Niranjayan | G07C 9/25 |
| 10,997,545 | B1 * | 5/2021 | Bhagwat | G06K 19/0716 |
| 11,049,342 | B1 * | 6/2021 | Mondrow | H04W 12/06 |
| 2012/0095797 | A1 * | 4/2012 | Nishimura | G06F 21/6236 726/20 |
| 2015/0116108 | A1 * | 4/2015 | Fadell | G08B 27/003 340/501 |
| 2016/0019733 | A1 * | 1/2016 | Robinton | G07C 9/20 340/5.61 |
| 2017/0132864 | A1 * | 5/2017 | Adam | G07C 9/00309 |
| 2018/0158267 | A1 * | 6/2018 | Kontturi | G07C 9/28 |
| 2018/0341393 | A1 * | 11/2018 | Frenette | H04W 4/023 |
| 2018/0357848 | A1 * | 12/2018 | McLellan | G06Q 10/083 |
| 2019/0035190 | A1 * | 1/2019 | Szczygiel | G07C 9/00309 |
| 2019/0066464 | A1 * | 2/2019 | Wedig | G08B 27/001 |
| 2019/0080538 | A1 * | 3/2019 | Shahidi | H04L 12/66 |

(Continued)

*Primary Examiner* — Daniel I Walsh

(57) ABSTRACT

A method for a security system includes receiving a first location and a first time period, retrieving an access control tree having nodes associated with locations and edges coupling nodes, wherein a first node represents the first location and a second node represents a building entry, traversing the access control tree from the second node to the first node to determine an ordered list of nodes and associated time periods, storing the ordered list of nodes and an identifier associated with a user, providing to a smart device a token associated with a requested access control point, when a requested node is within the first ordered list of nodes, and authorizing with the requested access control point a physical action visible to the user in response to the requested token.

20 Claims, 7 Drawing Sheets

LINKED LIST 228

| TIME PERIOD | NODE |
|---|---|
| 9-10 AM: | 206 BUILDING LOBBY |
| 9:30 – 10 AM: | 208 ELEVATOR |
| 9:45 – 11:15 AM: | 216 ENGINEERING (SPECIFIED MEETING 10-11 AM) |
| 10:45 – 11:30 PM: | 208 ELEVATOR |
| 10:45 – 12 PM: | 206 BUILDING LOBBY |
| 11:30 – 12 PM: | 212 IS |
| 11:45- 2:15 PM: | 224 SERVER (SPECIFIED MEETING 12-2 PM) |
| 1:45 – 2:30 PM: | 212 IS |
| 1:45 – 3 PM | 206 BUILDING LOBBY |

(56) References Cited

U.S. PATENT DOCUMENTS

| | | | | |
|---|---|---|---|---|
| 2019/0122462 | A1* | 4/2019 | Wedzikowski | G07C 9/28 |
| 2019/0246276 | A1* | 8/2019 | Lingala | H04W 56/001 |
| 2019/0287063 | A1* | 9/2019 | Skaaksrud | B60G 17/0152 |
| 2019/0287325 | A1* | 9/2019 | Paolo | G07C 9/28 |
| 2019/0340853 | A1* | 11/2019 | Manuse | G07C 9/00904 |
| 2019/0362572 | A1* | 11/2019 | Amuduri | H04W 4/029 |
| 2020/0160722 | A1* | 5/2020 | Brugman | G07C 5/08 |
| 2020/0168018 | A1* | 5/2020 | Novozhenets | G07C 9/28 |
| 2020/0234523 | A1* | 7/2020 | Ma | G06V 40/103 |
| 2020/0349785 | A1* | 11/2020 | Kuenzi | G07C 9/00571 |
| 2020/0351661 | A1* | 11/2020 | Kuenzi | H04L 67/20 |
| 2020/0372736 | A1* | 11/2020 | Higley | G07C 9/29 |
| 2021/0112064 | A1* | 4/2021 | Losseva | H04L 63/08 |
| 2021/0209875 | A1* | 7/2021 | Kuenzi | G07C 9/00571 |
| 2021/0209882 | A1* | 7/2021 | Kuenzi | H04W 4/00 |
| 2022/0027448 | A1* | 1/2022 | Takai | G06F 21/602 |

* cited by examiner

LINKED LIST 228

| TIME PERIOD | NODE |
|---|---|
| 9-10 AM: | 206 BUILDING LOBBY |
| 9:30 – 10 AM: | 208 ELEVATOR |
| 9:45 – 11:15 AM: | 216 ENGINEERING (SPECIFIED MEETING 10-11 AM) |
| 10:45 – 11:30 PM: | 208 ELEVATOR |
| 10:45 – 12 PM: | 206 BUILDING LOBBY |
| 11:30 – 12 PM: | 212 IS |
| 11:45- 2:15 PM: | 224 SERVER (SPECIFIED MEETING 12-2 PM) |
| 1:45 – 2:30 PM: | 212 IS |
| 1:45 – 3 PM | 206 BUILDING LOBBY |

METHODS AND APPARATUS FOR FACILITATING OPERATION OF CONTROL ACCESS SYSTEMS

CROSS-REFERENCE TO RELATED APPLICATIONS

The present patent application is a non-provisional of U.S. App. No. 62/913,599 filed Oct. 10, 2019, which is incorporated by reference for all purposes.

BACKGROUND

The present invention relates to methods and apparatus for facilitating operation of control access systems. More specifically, the present invention relates to reducing network traffic within a control access system to increase performance thereof.

With current embodiments of a control access system currently under development by the inventors of the present disclosure, access by users, employees, contractors or other personnel having a regular connection with a company, building, location, for example, may be preauthorized to access locations within a company before the users actually access these locations. These embodiments enable the users to have a good user experience, as their movements are relatively unrestricted within the company, etc.

In contrast, a large class of users having little or non-permanent connection with a company, e.g. delivery personnel, visiting personnel, service personnel, interviewees, business visitors, etc., are not typically provided company access before they arrive. Typically, these users will have poor visitor experiences due to delays in locating security personnel, delays in verifying users' credentials, delays in issuing temporary credentials, delays in finding hosts, and the like.

One solution to the visiting personnel experience problem is to provide such personnel with employee "loaner" badges, where the visitor can use the badge to move within the company. The inventors believe that a problem with this approach is that visiting personnel should not get access to all the locations where employees can typically access and that visitors should be confined to non-sensitive areas. To address this issue, a solution is to have another class of loaner badges available to be borrowed by visitors, where the visitor can use the loaner badge to move within restricted areas of the company. A problem with this approach is that visitors may have different purposes at the company, thus a loaner badge may not provide wide enough access to a company to where they need to go, or the visitor badge may provide too much access and allow them to go where they do not need to go. For example, a food-service visitor only needs access to the kitchen facilities; a press visitor only needs access to auditoriums; a server technician only needs access to the server rooms; etc. A problem with this solution is that there because there are so many different visitors and purposes, a company would wind up reserving one badge for each visitor. Another problem is that often loaner badges are not returned, so the IS staff will have to deactivate the loaner badge and have to purchase additional badges. Further, there is often a delay between when the visitor leaves and when a company discovers that the badge is missing. This delay may be days or even weeks, where anyone with the missing visitor badge will have free access to the company.

Manually determining where each visiting user will need to go and at what times, and programming custom access profiles for each visitor is virtually impossible for the security personnel (e.g. HR personnel, IS personnel, etc.) to do. Importantly, it would also be burdensome for the control access security. In a typical day, there may be hundreds of visitors to a building, so it will be impossible for the HR personnel and Administrators to quickly and accurately customize access profiles to determine which users get access to which doors, floors, rooms, and assets for what times, etc. Additionally, as most visitor access will be added on an ad hoc basis (e.g. delivery to person A, interview with person B, bathroom visitor) it is contemplated that providing such access will often be a series of single transactions with the security server. For example, an HR personnel or the IS personnel may provide access to a delivery person to the front door, but forget to add access to an elevator, or forget to add access to the shipping dock, or forget to add access to the bathroom, and the like, thus multiple transactions with the security server will be required for each visitor. As a result of this, when there are a large number of visitors, the security server will be heavily burdened with each new access authorization, and the security server will suffer performance degradation. Because of this, even though employees in a building may have the appropriate badges, the security system may be slow or unresponsive, and the user experience for all users in the building will suffer. This is especially true in low-cost systems with limited user capacity where hitting of database limits greatly degrades performance.

In light of the above, what is desired are improved control access systems without the drawbacks described above.

SUMMARY

The present invention relates to reducing network traffic within a control access system. More specifically, the present invention relates to optimizing transactions to a networked security system and/or optimizing transactions with user devices, to increase efficiency of such systems.

In various embodiments of the present invention, a resource allocation server is provided that receives a specification of resources required (including to be allocated) to users along with time periods for allocation of such resources. A scheduling server receives the resource and time specification and determines a specification of additional resources required (or allocated) to users along with additional time periods for allocation of the additional resources. A security server receives the specification of the resources required along with the time periods, the specification of the additional resources and additional time periods, and updates a security database in one or a few transactions. Additionally, the security server computes access tokens associated with the resources required and time periods and the additional resources and additional time periods, and typically provides the access tokens for storage onto a user smart device in a single (or reduced number) of transactions. In operation, the user smart device provides these access tokens to appropriate localized access control systems (e.g. a door, a turnstile, conference room, etc.) or other assets on the fly. In other embodiments, tokens may not be required, and the security server can provide the specification of resources and additional resources associated with the user to an access server. In such examples, when a user presents their credentials (e.g. user ID) to a resource (e.g. a security door), the credentials are sent to the access server which in turn determines whether the user is authorized for that resource (i.e. can enter). In some examples, the time the user is allowed to access the resource should be within the allocated time periods.

According to one aspect, a method for a security system is described. One technique may include receiving in a processor a first identifier associated with a first geographic location within a building and a first time period associated with the first geographic location, and retrieving from a memory an access control tree, wherein the access control tree comprises a plurality of nodes and a plurality of edges, wherein the plurality of nodes are associated with access control points of the building, wherein the plurality of nodes comprises a first node is associated with the first geographic location and a second node associated with a second access control point associated with a building entry location of the building, and wherein the plurality of edges couple adjacent access control points within the building. A method may include traversing with the processor the access control tree from the second node to the first node to thereby determine a first ordered list of nodes, wherein the first ordered list of nodes includes a first time period associated with the first node and a second time period associated with the second node, storing in the memory an association of the first ordered list of nodes with an identifier associated with a user; and providing with a first transceiver to a smart device a requested token associated with a requested access control point, when a requested node associated with the requested access control point is within the first ordered list of nodes. In some embodiments, a requested token is output from the smart device to cause the requested access control point to become unlatched.

According to another aspect, a method for a security system is described. One process may include receiving via a first transceiver from a smart device a first identifier associated with a first access control point and a user identifier associated with a user of the smart device, and retrieving from a memory a first ordered list of nodes in response to the user identifier, wherein the first ordered list of nodes is associated with a first plurality of access control points. A technique may include determining in a processor whether the first access control point is within the first plurality of access control points, and determining a first token associated with the first access control point when the first access control point is within the first plurality of access control points. Operations may include providing via the first transceiver to the smart device the first token in response to the first access control point being within the first plurality of access control points. In some embodiments, the first token is output from the smart device to cause the first access control point to become unlatched.

According to yet another aspect, a security system is disclosed. One apparatus may include a first transceiver configured to receive from a smart device a first identifier associated with a first access control point and a user identifier associated with a user of the smart device, and a memory configured to retrieve a first ordered list of nodes in response to the user identifier, wherein the first ordered list of nodes is associated with a first plurality of access control points. One device may include a processor configured to determine whether the first access control point is within the first plurality of access control points, wherein the processor is configured to determine a first token associated with the first access control point when the first access control point is within the first plurality of access control points. In some embodiments, the first transceiver is also configured to provide to the smart device the first token in response to the first access control point being within the first plurality of access control points, and the first token is output from the smart device to cause the first access control point to become unlatched.

DRAWINGS

In order to more fully understand the present invention, reference is made to the accompanying drawings. Understanding that these drawings are not to be considered limitations in the scope of the invention, the presently described embodiments and the presently understood best mode of the invention are described with additional detail through use of the accompanying drawings in which.

Figure 3A:
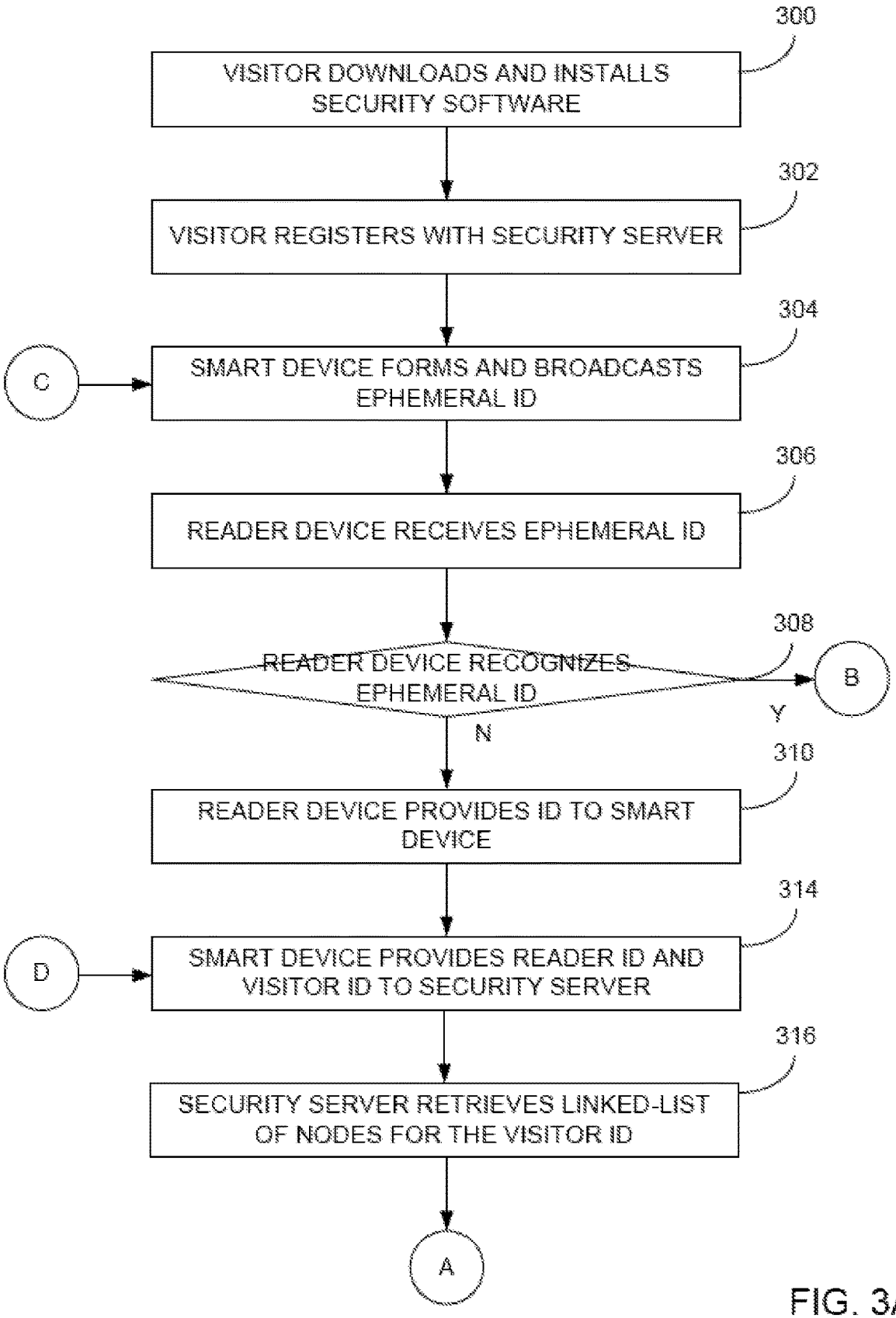
Figure 3B:
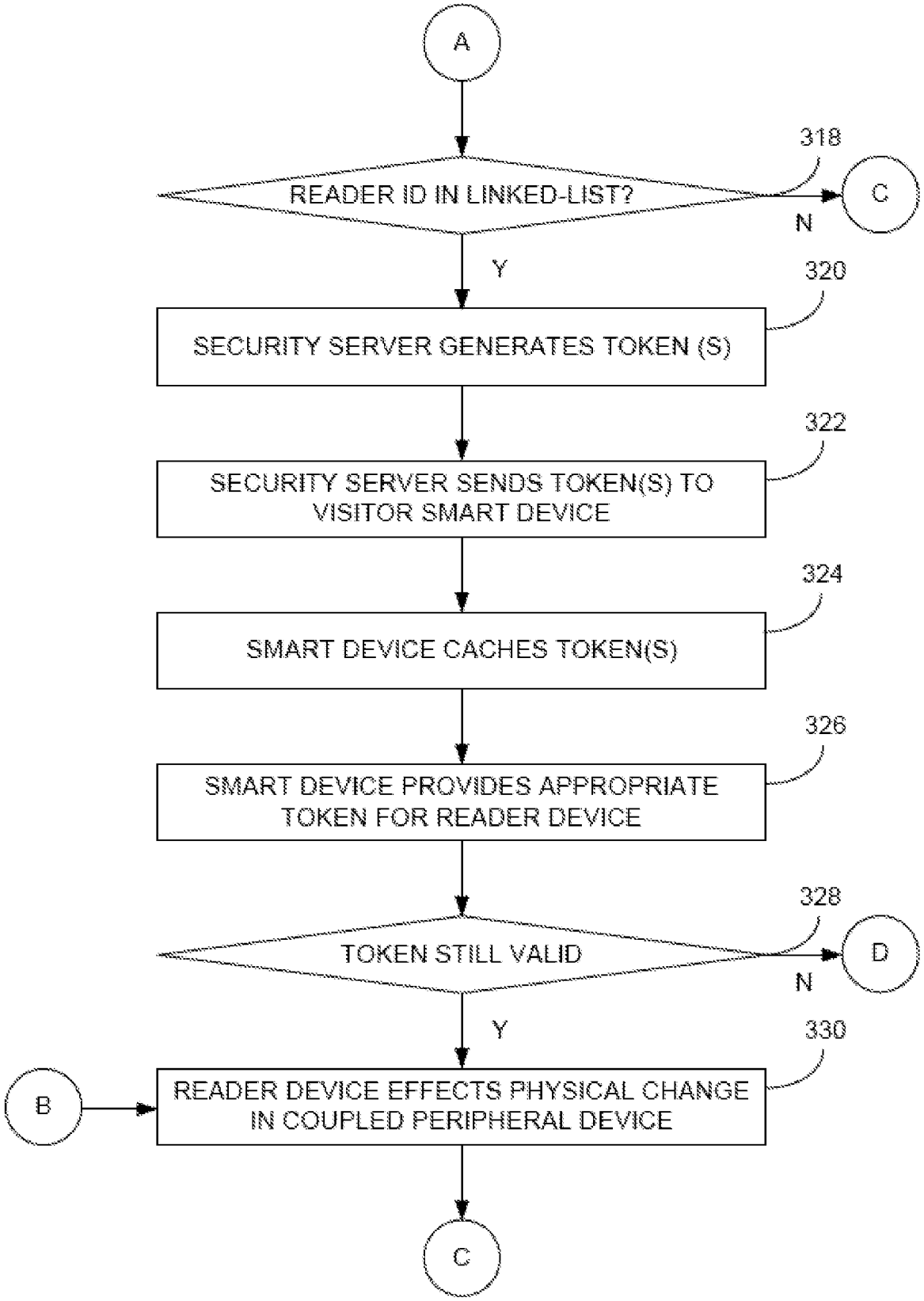
Figure 4:
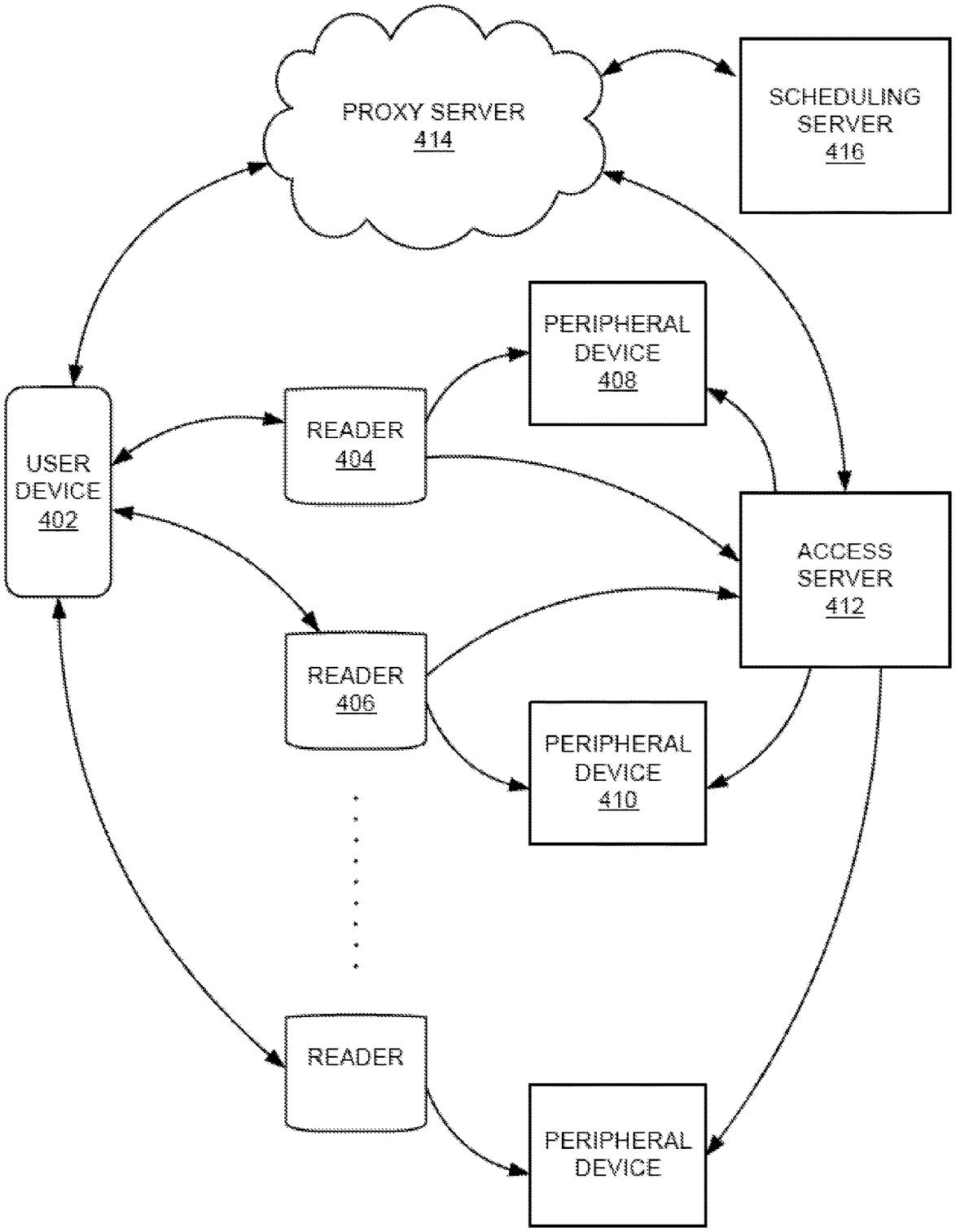
Figure 5:
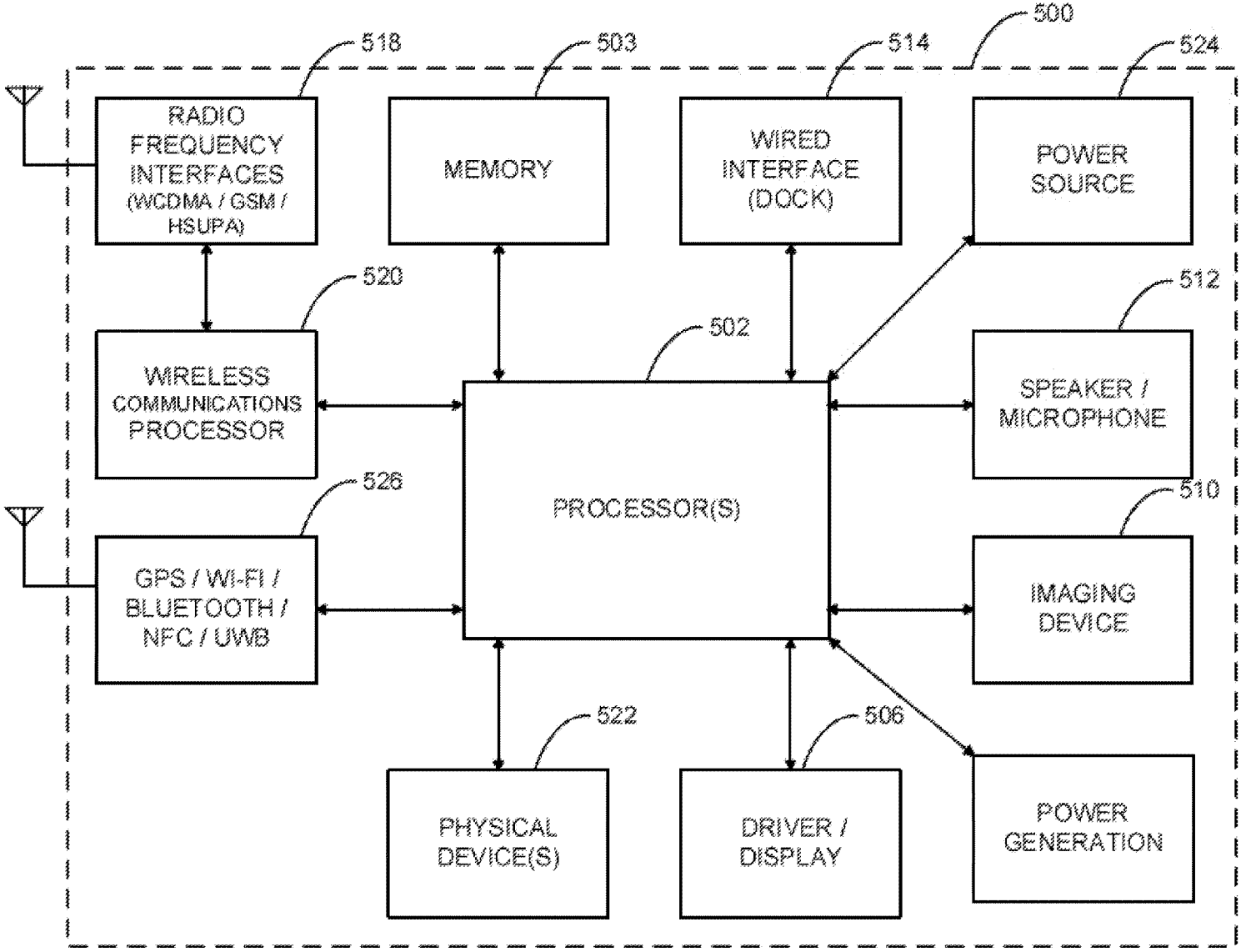
Figure 6:
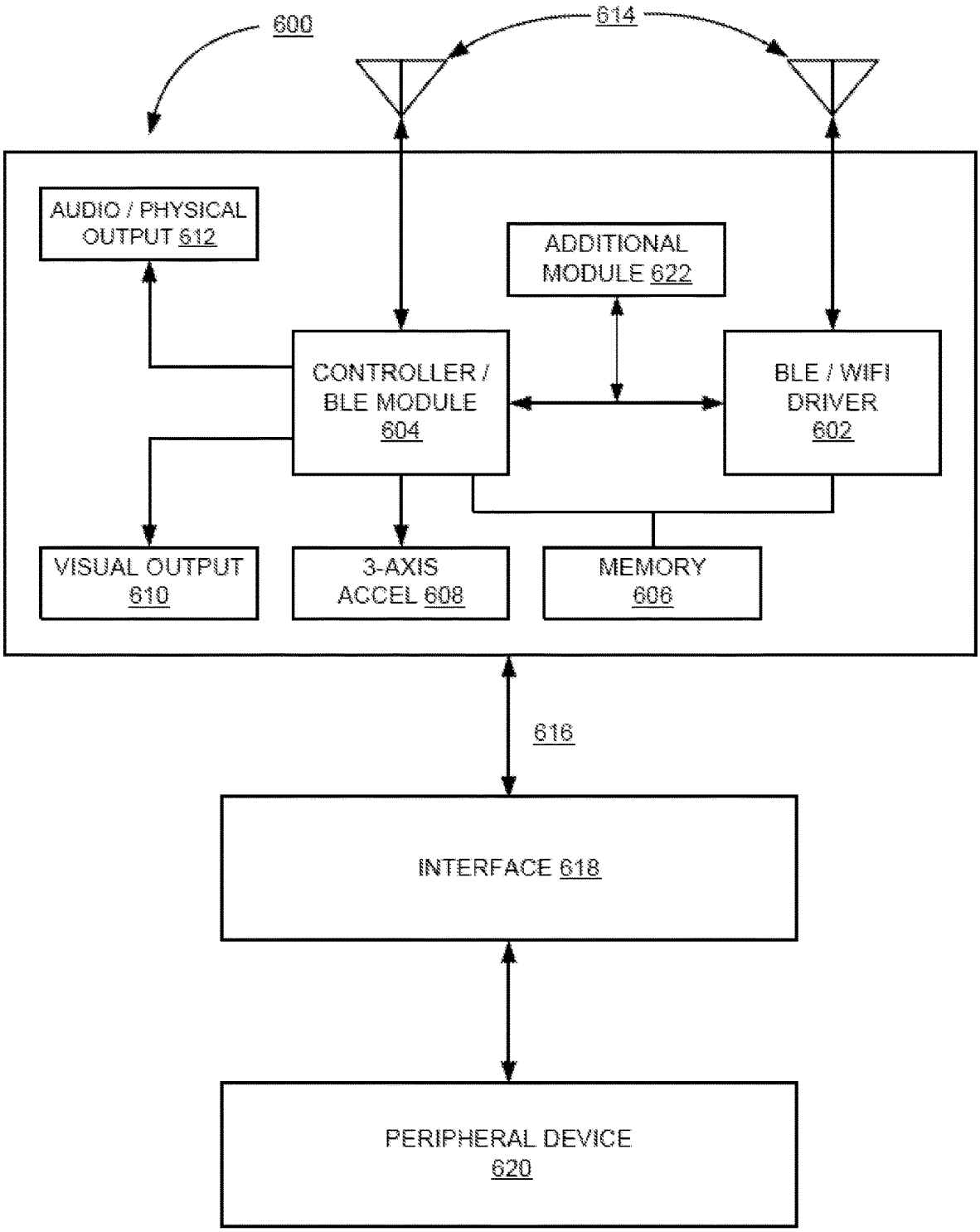

FIGS. 3A-B illustrates another flow diagram according to various embodiments;

FIG. 4 illustrates a logical block diagram according to various embodiments;

FIG. 5 illustrates a system block diagram according to various embodiments; and FIG. 6 illustrates a reader device block diagram according to various embodiments.

DESCRIPTION

Figure 1:
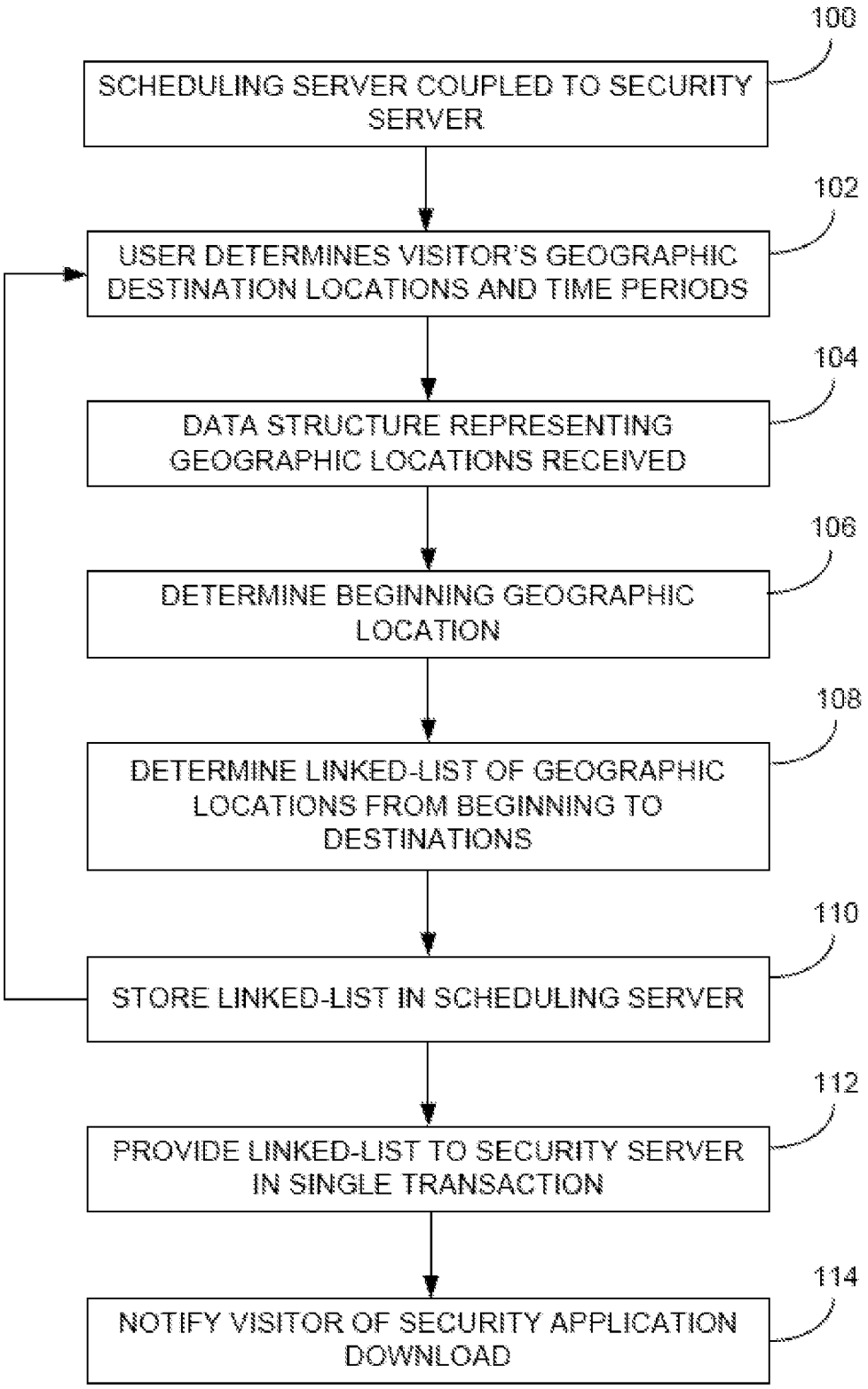
FIG. 1 illustrates a flow diagram according to various embodiments.

FIG. 1 illustrates a block diagram of a process according to some embodiments of the present invention. More specifically, FIG. 1 illustrate methods for initializing user access within a secure area with a reduced number of data transactions. In FIG. 1, as well as FIGS. 3A-B various steps and operations performed within a security system are described below. To better visualize the interaction between components of embodiments of the present invention, these steps are performed on a system block diagram similar to that illustrated in FIG. 4.

FIG. 4 illustrates a logical block diagram according to various embodiments of the present invention. In FIG. 4, a user smart device 402 (e.g. a smart phone, smart watch, ring, tablet, wearable device, augmented reality glasses, or the like) is illustrated coupled to one or more readers simultaneously or at different times, such as reader 404, reader 406, etc. In various embodiments, communications between and among device 402 and the readers may be via a short-range communications, such as Bluetooth Low Energy (BLE), Zigbee, IR, Wi-Fi, mesh network, or the like. In this example, reader 404 is coupled to and can control a peripheral device 408, reader 406 is coupled to and can control a peripheral device 410, etc. In other examples, readers 404 and 406 may simply be passive sensors and not control peripheral devices (e.g. 408, 410). In such embodiments, readers 404 and 406 may be used to simply determine a presence of a user (e.g. if the user is in a room, has passed by a specific location, if a user walks through particular doors, or the like). In some embodiments, an access control server 412 may also be used to facilitate control of the peripheral devices.

In some embodiments, user smart device 402 may be a combination of a smart phone and low-power device, such as a smart ring, smart glasses, or the like. In such cases, communications by the low-power device and servers, such as security server 414 are facilitated by another smart device transceivers (e.g. smart phone, smart watch). In particular, the low-power devices communicate via a short range communications (e.g. Bluetooth, UWB, or the like) with the smart phone, and in turn the smart phone communicates via wide area networks with the remote networked servers. Further, in these embodiments, the low-power device, e.g. a smart ring, may interact with readers, e.g. reader 404, 406, etc. via short-range communications (e.g. BLE, UWB, etc.). In embodiments where tokens are required by the readers, the low-power devices utilize the coupled smart phone to receive one or more tokens from security server 414. The low-power device then can interact with multiple readers using the cached tokens without requiring help of the smart phone. In embodiments where tokens are not required by the readers, the low-power devices provide user identifiers to readers, that may be sent to an access server 412. In these cases the user identifiers may be ephemeral IDs, as discussed herein, and access server 412 may rely upon security server 414 to determine if the ephemeral IDs are associated with authorized users.

In FIG. 4, a security server 414 is also shown coupled to smart device 402, typically via a wide-area-network communications, such cellular, 4G, 5G, mesh network, Wi-Fi, or the like. As will be discussed below, security server 414 may provide tokens to smart device 402 upon request of the security application running upon smart device 402. A scheduling server 416 is also illustrated coupled to security server 414 via a similar wide-area-network communications channels. In some embodiments, scheduling server 416 and security server 414 may be cloud-based servers, and user access may be via a web browser, an application, or the like. As will be discussed below, scheduling server 416 may provide a graphical user interface or other user interface for a user (e.g. administrator) to schedule a visitor's visit, e.g. specifying meeting times and places, specifying asset access, etc. Additionally, scheduling server 416 may perform various functions described below, such as determining a linked-list of nodes for the visitor's visit from a tree-type data structure.

In FIG. 1, Initially, a security system is provided that includes a scheduling server 416 coupled to a security server 414, step 100. Using scheduling server 416, a user, administrator, IS personnel, or the like may specify assets and times, such as one or more geographic locations where a visitor will visit (e.g. a destination location), a computer which a visitor can access, etc., step 102. In various examples, the geographic locations may be locations (e.g. meeting rooms, loading docks, seating locations, and the like) within a building; rooms within different buildings (e.g. a security building, a boarding building, and the like); or the like. Such locations are typically associated with near-by control access points. For example, if a geographic location is room 54-100, for a visitor to get to room 54-100 the user has to take the Green Building elevator that requires a key card. Accordingly, the access control point for 54-100 may be the Green Building elevator.

Additionally, the user may specify certain time periods for the visit. For example, the user may specify that a visitor will need to be in room 34-101 from 11 AM to 12 PM and room 26-100 between 1 PM to 2 PM; a visitor will need to be in security by 10 PM and in a waiting room between 10 PM-12 AM; and the like. Any number of programs or graphical user interfaces may be provided by the scheduling server 416 to give the user this selection capability. In some examples, the GUI may provide a series of drop-down menus, radio buttons, selectable icons, or the like to allow the user to specify the geographic locations and associated time periods, and the like for visitors.

In some embodiments, in response to the scheduling specification, the scheduling server 416 retrieves a data structure that includes access control points, including one or more that the visitor must pass through to reach the specified geographic locations, step 104. In various embodiments, this data structure is a tree-type structure including nodes and edges, where nodes are associated with specific access control points in a building (or facility, campus, etc.), for example, and the edges link adjacent access control points.

Figure 2:
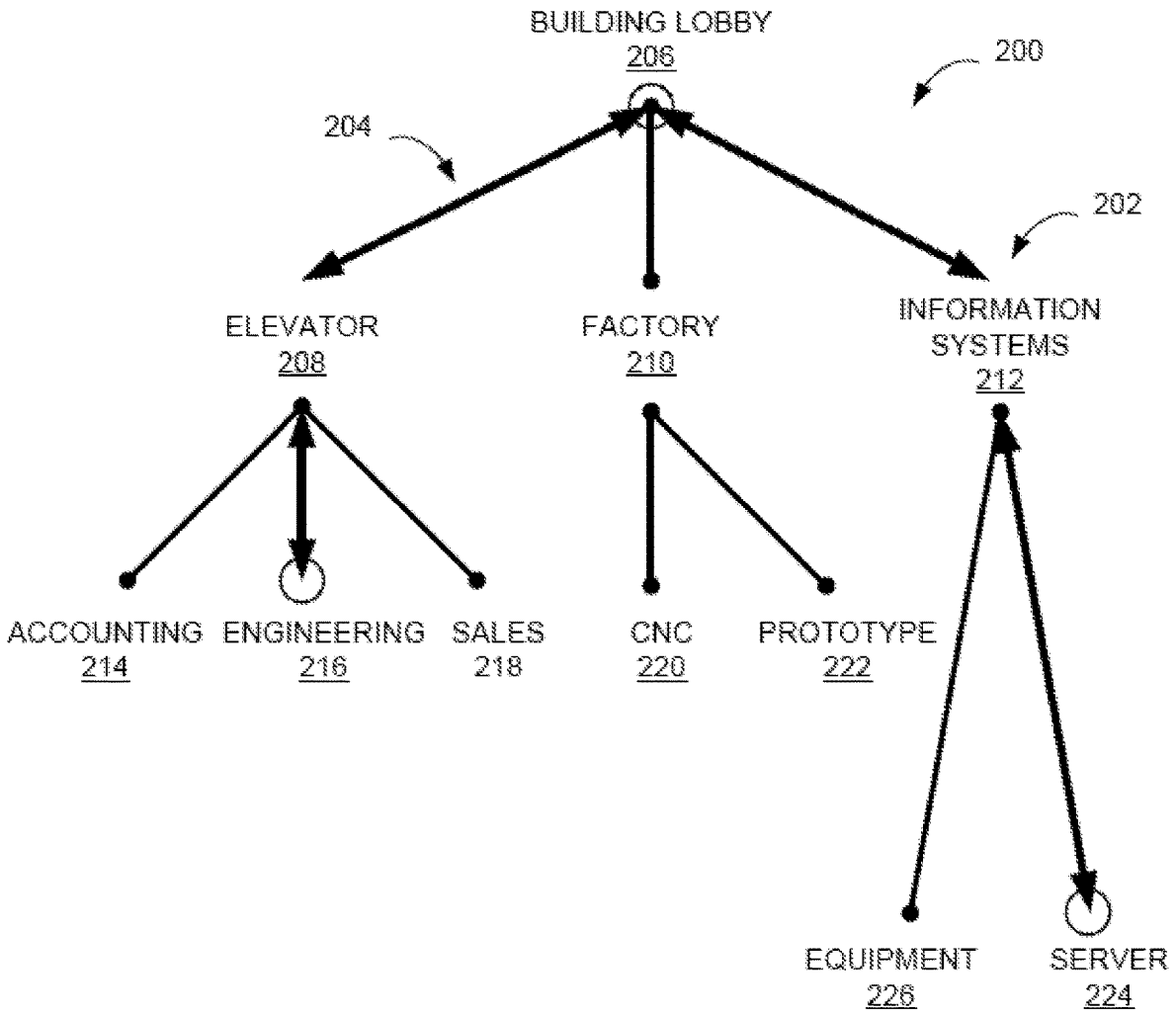
FIG. 2 illustrates a data structure according to various embodiments.

FIG. 2 illustrates an example of a data structure according to some embodiments of the present invention. More specifically, FIG. 2 illustrates a tree-type data structure 200 having nodes 202 and edges 204. In this example, node 206 may represent a security door, a turnstile, or other beginning access control point of a building, a facility, a campus, etc. As can be seen, node 206 is coupled to nodes 208, 210 and 212, where node 208 represents a call elevator button, node 210 is associated with an access door leading into a factory floor, and node 212 is associated with an access door leading to computer facilities.

In this example, the elevator call button associated with node 208 may have nodes coupled therewith representing different user (visitor) selectable floors (e.g. different companies or business groups), for example, node 214 may be associated with access to a second floor/an accounting group; node 216 may be associated with access to a third floor/engineering group; node 218 may be associated with access to a fourth floor/sales group; etc. Additionally, in this example, node 210 may represent an access door to the factory may be coupled to a node 220 that represents a controlled access door leading to a CNC facility; a node 222 may represent a controlled access door leading to a prototype assembly line; and the like. Lastly, in this example, node 212 may represent an access door leading to computer facilities and may be coupled to a node 224 that represents a security door for a server room, and node 226 represents a security door for an equipment room; and the like.

Returning to the flow chart in FIG. 1, it is sometimes assumed that if a visitor will be visiting a geographic location provided in step 102, the visitor will be originating their visit via a specific access control point, e.g. a turnstile, gate, security desk or other access control point, in the lobby of a building, or the like (a starting location), step 106. Next, in some embodiments, the data structure representing the access control points is traversed from a starting location node to a node associated with the destination location and includes intervening nodes, step 108. The nodes that are traversed are used to form a linked and ordered list of nodes. In some embodiments, there may be multiple paths between the starting location to the destination location. In some cases, a single or most direct path may be specified in the linked list; in other embodiments multiple paths may be included; in still other embodiments, multiple paths may be included, however these paths may be limited to having a limited number of extra nodes (e.g. one or two additional nodes) compared to the most direct path; and the like.

As a simple example of a linked list, in FIG. 2, a starting location may be assumed to be an entry location (entry door, entry gate, entry check-in kiosk, visitor kiosk etc.) represented by node 206, and a destination location may be specified to be the engineering group represented by or associated with node 216. In this example, as data structure 200 is traversed from node 206 to node 216, node 208 (e.g. elevator call access) is included, accordingly a linked list will include in order: nodes 206, 208, and 216.

In some embodiments, the linked list and an identifier associated with the visitor (e.g. name, vendor number, etc.) may be stored on the scheduling server 416, step 110.

In various embodiments, the linked list may be associated with specific time periods. For example, referring to FIG. 1 and the example in FIG. 2, in step 102 the specified destination is the engineering group (node 216) for a meeting from 1 to 2 PM. Accordingly, in the linked list, time periods may be automatically determined for the other nodes, such as 206 and 208. In the present example, assuming the user arrives before the meeting time, the time period associated with the entry (node 206) may be set to beginning an hour before the meeting time and ending 30 minutes after the meeting time, e.g. 12 to 2:30 PM; the beginning of the timing period may be automatically set to 30 minutes before the meeting time; the ending of the timing period may be set to 30 minutes after the beginning of the meeting time (e.g. 12:30 PM); or the like. Additionally, in various embodiments, the time period associated with access to the elevator (node 208) may be automatically determined. For example, the time period for node 208 may be similar to the time period for the entry (node 206) (e.g. 12 to 2:30 PM); the beginning of the timing period may be set to 15 minutes before the meeting time (e.g. 12:45 PM); the ending of the timing period may be set to 15 minutes after the beginning of the meeting time (e.g. 1:15 PM); or the like. In some examples, the authorized time periods associated with each node may be different and depend upon how geographically far adjacent nodes are to one another. For example, if a first node is associated with a meeting beginning at 10 AM, a second node adjacent to the first node may have a beginning time period of 9:45 AM, a third node adjacent to the first node may have a beginning time period of 9:30 AM, and a fourth node adjacent to the third node may have a beginning time period of 9 AM. In various embodiments, as will be described below, tokens for access control points are given time periods of validity, are used to enforce the above time period restrictions.

In various embodiments, setting periods of time for the different nodes helps further constrain authorized access by visitors. In some cases, if a visitor overstays their visit, the visitor will be unable to access the locations they were authorized to access. If other cases, if a visitor is arriving too late, the visitor schedule may have changed, accordingly the visitor should be denied access to the scheduled locations.

In some embodiments, in step 102, multiple destinations and time periods may be specified by the user, and the linked-list in step 108 may include a list of nodes for the entire visitor's visit. In other embodiments, in step 102 only one destination/time period is specified at a time. Accordingly, in such cases, the process described above may be repeated for each additional geographic destination, using the appropriate beginning locations, to create the linked-list of nodes.

Continuing the example in FIG. 2, after the first destination of Engineering 216, a second destination may be specified for the visitor, such as server room 224. In various embodiments, data structure 200 is then traversed from Engineering 216 to Server 224 and identifies nodes 208, 206 and 212. Lastly, in this example, the linked-list may include nodes that allow the visitor to exit the facility, back via node 212 to 206. In the present example, a list-list 228 is determined in response to the user specifying a 10-11 AM meeting in Engineering 216 and a 12-2 PM meeting in the Server Room 224.

In some embodiments, the linked list of nodes with time periods and an identifier associated with the visitor (e.g. name, vendor number, etc.) may also be sent to a security server 414, step 112. This operation may take place in a single transaction, in some cases. In other cases, this operation may involve several transactions. In various embodiments, because the visitor identifier and the linked list of nodes is stored in the security server 414, typically in one transaction, the security server 414 is not burdened with a transaction for every single node the visitor is associated with. As will be described further below, in some embodiments, the security server 414 may be a cloud-based server that interacts with an application running upon a visitor's smart device 402. In other embodiments, the security server 414 may be a cloud-based server that also interacts with an access control server 412.

Subsequently, the visitor may be made notified that they are authorized to visit, step 114. In some examples, the visitors may be sent an e-mail message from scheduling server 416 inviting them to download and install a security application on their smart-device 402 (e.g. phone, smart watch). In various embodiments, software such as that provided by the assignee of the current application may be downloaded from a third-party web site, such as Apple App Store, Google Play, or the like, or other source.

FIGS. 3A-B illustrates a block diagram of a process according to some embodiments of the present invention. More specifically, FIG. 3 illustrate methods for providing user access within a secure area with a reduced number of data transactions. FIG. 4 will be again referred to for sake of convenience to the reader.

In some embodiments, the visitor downloads the security application on their smart-device 402, step 300, and registers with cloud-based security server 414, step 302. As a result of these steps, the visitor and the visitor's smart phone may be personally identified to security server 414.

In some embodiments, as part of the visitor registration process, a visitor may have to provide a user identification (e.g. passport, driver's license, employee badge, etc.). In response, the visitor identification may be authenticated by local software or software via SaaS, e.g. withpersona.com, Veriff, or the like. In some embodiments, as part of the registration process, the visitor may also be required to sign one or more agreements, e.g. non-disclosure agreements (NDA), liability release agreements, assignment of rights agreements, or the like. The signing process may be an on-line e-signature SaaS, such as DocuSign, and the like. In some embodiments, without providing these items, the visitor may not be registered, authorized to visit, or the like.

In some embodiments, when the security application is running upon the smart-device 402, the smart-device broadcasts an ephemeral ID (via a short-range transceiver, e.g. Bluetooth Low Energy (BLE)), that does not personally identify the visitor, step 304. Next, when the visitor arrives at the building or location, for example, a visitor entering a lobby of a building, the ephemeral ID is captured by a reader unit 404, step 306. In various embodiments, the reader unit 404 may be associated with a specific access control point, e.g. a turnstile, gate, or other access control point, in the lobby of a building, or the like (a starting location), and the reader unit 404 may directly or indirectly control the specific access control point 408. In some examples, this reader unit 404 may be the first node on the linked-list of nodes associated with the visitor.

In various embodiments, in response to the ephemeral ID, the reader unit 404 determines if it recognizes the ephemeral ID (from a previous transaction) or requests a token or other authorizing identifier from the visitor's smart device 402, step 308. This situation covers cases where the visitor may have visited earlier during the day or during the previous day, and a token authorizing access to the access control point was previously presented, or the like. In other embodiments, if devices have previously accessed reader device 404 within a predetermined length of time ago (e.g. 8 hours ago, 24 hours ago, 2 hours ago, etc.) and provided a valid token at that time, reader device 404 may cache the MAC addresses of such devices. Accordingly, in some embodiments, in this step, reader device 404 may determine if the MAC address of the incoming user device 402 is stored in the cache of MAC addresses or not.

In some embodiments, if the incoming MAC address is not cached in reader device 404, the MAC address of the user device 402 may have rotated or changed since the last time the user device 402 paired with reader device 1404. In some embodiments, if the user's last visit is within the period of time a token is valid (e.g. 8 hours, 4 hours, etc.) it may still be desired to have the user's device 402 be authenticated by reader device 404. In some examples, to do this, a token authentication key is included in the token as payload data and may be stored in both the reader device 404 and the user device 402. This token authentication key may then be used to authenticate the user device 402. In one example, the user device 402 may sign a message using the token authentication key (e.g. a symmetric key), the signed message is passed to reader device 404, then using the token authentication key, reader device 404 determines whether the message is properly signed. In other examples, a token may use asymmetric keys, and the user device 402 may then encrypt a message with the first key and reader device 404 may decrypt the message using the second key. If the message is properly recovered, reader device 404 authenticates user device 402. In other embodiments, other processes for authentication of the user device are contemplated.

In some embodiments, if the user device is not recognized, reader unit 404 may provide a unique identifier to the smart device 402, step 310. Subsequently, the security application on the smart device contacts the security server 414 (via a wide-area-network e.g. Wi-Fi, Cellular, 4G, 5G) and provides the unique identifier and other data (e.g. a nonce) of the reader unit 404, and user information personally identifying the user, step 314. In response to the user information, the security server 414 retrieves the linked-list of nodes, step 316, then in response to data stored within the unique identifier of the reader unit 404, the security server determines whether the reader unit 404 is on the linked-list of nodes, step 318. If not, no further user-access actions are performed.

In some embodiments, if the reader unit 404 is on the linked-list of nodes, the security server 414 may generate tokens (each possibly having time periods of validity) for each node (each reader device) on the linked-list of nodes, step 320. Next, the security server 414 passes the tokens back to the security application running upon the visitor's smart device 402, step 322. These tokens may then be cached upon the smart device 402, step 324. In various embodiments, by providing multiple tokens to the smart device 402 in one transaction the security server 414 need not be burdened by repeated requests by the smart device 402 for tokens for each access control point on the linked-list as the user approaches them.

Subsequently, in response to the reader unit 404 request in step 304, the token associated with the reader unit 404 may be output by the security application on smart device 402, step 326. If the reader unit 404 determines that the received token is still valid (e.g. used within the authorized time period), step 328, the reader unit 404 may electrically and physically control the specific access control point 408, and allow the visitor to turn a turnstile, open a gate, press a button, use the device, and the like, step 330.

In other embodiments, before allowing the visitor access, reader unit 404 may pass portions of the token, e.g. payload data (a loyalty card number, a frequent flyer number, token encryption key(s), user preferences, user login information, and the like), to access server 412, which then determines whether the visitor is authorized or not. Access server 412 may control peripheral device 408 based upon the linked list of nodes, from scheduling server 416 or security server 414.

In various embodiments, the process above may be repeated for additional reader units (e.g. 406) the visitor encounters within the building or facility. For example, when the reader unit 406 is approached and associated with a node within the linked list of nodes, the cached token is provided by the smart device 402 to the reader device 406, and when the reader device 406 determines that the cached token is valid, the reader device 406 also performs a physical action and allows the user access to the access control point. In some cases, the list of tokens need not be provided to the visitor's smart device 402 at one time in step 322. Instead, the tokens may be provided only when the user's smart phone 402 approaches the reader unit coupled to the next node on the linked-list. Such embodiments may be used to enforce the order of visitor progress within a building or location, as is discussed further below.

FIG. 5 illustrates a functional block diagram of various embodiments of the present invention. More specifically, it is contemplated that from user smart devices to cloud-based servers may be implemented with a subset or superset of the below illustrated components. In FIG. 5, a computing device 500 typically includes an applications processor 502, memory 504, a display 506, an image acquisition device 510, audio input/output devices 512, and the like. Additional communications from and to computing device 500 can be provided by via a wired interface 514 (e.g. dock, plug); a GPS/Wi-Fi/Bluetooth interface/UWB 516; RF interfaces 518 and driver 520, and the like. Also included in some embodiments are physical sensors 522 (e.g. (MEMS-based) accelerometers, gyros, magnetometers, pressure sensors, temperature sensors, bioimaging sensors etc.).

In various embodiments, computing device 500 may be a hand-held computing device (e.g. Apple iPad, Microsoft Surface, Samsung Galaxy Note, an Android Tablet); a smart phone (e.g. Apple iPhone, Google Pixel, Samsung Galaxy S); a portable computer (e.g. netbook, laptop, convertible), a media player (e.g. Apple iPod); a reading device (e.g. Amazon Kindle); a fitness tracker (e.g. Fitbit, Apple Watch, Garmin or the like); a headset or glasses (e.g. Oculus Rift, HTC Vive, Sony PlaystationVR, Magic Leap, Microsoft HoloLens); a wearable device (e.g. Motiv smart ring, smart headphones); an implanted device (e.g. smart device medical) or the like. Typically, computing device 500 may include one or more processors 502. Such processors 502 may also be termed application processors, and may include a processor core, a video/graphics core, and other cores. Processors 502 may include processor from Apple (A12, A13), NVidia (Tegra), Intel (Core), Qualcomm (Snapdragon), Samsung (Exynos), ARM (Cortex), MIPS technology. In some embodiments, processing accelerators may also be included, e.g. an AI accelerator, Google (Tensor processing unit), a GPU, or the like. It is contemplated that other existing and/or later-developed processors may be used in various embodiments of the present invention.

In various embodiments, memory 504 may include different types of memory (including memory controllers), such as flash memory (e.g. NOR, NAND), SRAM, DDR SDRAM, or the like. Memory 504 may be fixed within computing device 500 and may include removable (e.g. SD, SDHC, MMC, MINI SD, MICRO SD, CF, SIM). The above are examples of computer readable tangible media that may be used to store embodiments of the present invention, such as computer-executable software code (e.g. firmware, application programs), security applications, application data, operating system data, databases or the like. It is contemplated that other existing and/or later-developed memory and memory technology may be used in various embodiments of the present invention.

In various embodiments, display 506 may be based upon a variety of later-developed or current display technology, including LED or OLED status lights; touch screen technology (e.g. resistive displays, capacitive displays, optical sensor displays, electromagnetic resonance, or the like); and the like. Additionally, display 506 may include single touch or multiple-touch sensing capability. Any later-developed or conventional output display technology may be used for the output display, such as LED IPS, OLED, Plasma, electronic ink (e.g. electrophoretic, electrowetting, interferometric modulating), or the like. In various embodiments, the resolution of such displays and the resolution of such touch sensors may be set based upon engineering or non-engineering factors (e.g. sales, marketing). In some embodiments, display 506 may integrated into computing device 500 or may be separate. Status lights, e.g. LEDs may also be used.

In some embodiments of the present invention, acquisition device 510 may include one or more sensors, drivers, lenses and the like. The sensors may be visible light, infrared, and/or UV sensitive sensors that are based upon any later-developed or convention sensor technology, such as CMOS, CCD, or the like. In some embodiments of the present invention, image recognition algorithms, image processing algorithms or other software programs for operation upon processor 502, to process the image data. For example, such software may pair with enabled hardware to provide functionality such as: facial recognition (e.g. Face ID, head tracking, camera parameter control, or the like); fingerprint capture/analysis; blood vessel capture/analysis; iris scanning capture/analysis; otoacoustic emission (OAE) profiling and matching; and the like. In various embodiments of the present invention, imaging device 510 may provide user input data in the form of a selfie, biometric data, or the like.

In various embodiments, audio input/output 512 may include conventional microphone(s)/speakers. In various embodiments, voice processing and/or recognition software may be provided to applications processor 502 to enable the user to operate computing device 500 by stating voice commands. In various embodiments of the present invention, audio input 512 may provide user input data in the form of a spoken word or phrase, or the like, as described above. In some embodiments, audio input/output 512 may be integrated into computing device 500 or may be separate.

In various embodiments, wired interface 514 may be used to provide data transfers between computing device 500 and an external source, such as a computer, a remote server, a storage network, another computing device 500, a client device, or the like. Embodiments may include any later-developed or conventional physical interface/protocol, such as: USB, micro USB, mini USB, USB-C, Firewire, Apple Lightning connector, Ethernet, POTS, custom dock, or the like. In some embodiments, wired interface 514 may also provide electrical power, or the like to power source 524, or the like. In other embodiments interface 514 may utilize close physical contact of device 500 to a dock for transfer of data, magnetic power, heat energy, light energy, laser energy or the like. Additionally, software that enables communications over such networks is typically provided.

In various embodiments, a wireless interface 516 may also be provided to provide wireless data transfers between computing device 500 and external sources, such as computers, storage networks, headphones, microphones, cameras, or the like. As illustrated in FIG. 5, wireless protocols may include Wi-Fi (e.g. IEEE 802.11 a/b/g/n, WiMAX), Bluetooth, Bluetooth Low Energy (BLE) IR, near field communication (NFC), ZigBee, Ultra-Wide Band (UWB), Wi-Fi, mesh communications, and the like. As described above, data transmissions between computing device 500 and identity reader 1104 may occur via UWB, Bluetooth, ZigBee, Wi-Fi, a mesh network, or the like.

GPS receiving capability may also be included in various embodiments of the present invention. As illustrated in FIG. 5, GPS functionality is included as part of wireless interface 516 merely for sake of convenience, although in implementation, such functionality may be performed by circuitry that is distinct from the Wi-Fi circuitry, the Bluetooth circuitry, and the like. In various embodiments of the present invention, GPS receiving hardware may provide user input data in the form of current GPS coordinates, or the like, as described above.

Additional wireless communications may be provided via RF interfaces 518 and drivers 520 in various embodiments. In various embodiments, RF interfaces 518 may support any future-developed or conventional radio frequency communications protocol, such as CDMA-based protocols (e.g. WCDMA), GSM-based protocols, HSUPA-based protocols, G4, G5, or the like. In the embodiments illustrated, driver 520 is illustrated as being distinct from applications processor 502 and wireless interface 516. However, in some embodiments, various functionality are provided upon a single IC package, for example the Marvel PXA330 processor, and the like. It is contemplated that some embodiments of computing device 500 need not include the wide area RF functionality provided by RF interface 518 and driver 520.

In various embodiments, any number of future developed, current operating systems, or custom operating systems may be supported, such as iPhone OS (e.g. iOS), Google Android, Linux, Windows, MacOS, or the like. In various embodiments of the present invention, the operating system may be a multi-threaded multi-tasking operating system. Accordingly, inputs and/or outputs from and to display 506 and inputs/or outputs to physical sensors 522 may be processed in parallel processing threads. In other embodiments, such events or outputs may be processed serially, or the like. Inputs and outputs from other functional blocks may also be processed in parallel or serially, in other embodiments of the present invention, such as acquisition device 510 and physical sensors 522.

In some embodiments of the present invention, physical sensors 522 (e.g. MEMS-based) accelerometers, gyros, magnetometers, pressure sensors, temperature sensors, imaging sensors (e.g. blood oxygen, heartbeat, blood vessel, iris data, etc.), thermometer, otoacoustic emission (OAE) testing hardware, and the like may be provided. The data from such sensors may be used to capture data associated with device 500, and a user of device 500. Such data may include physical motion data, pressure data, orientation data, or the like. Data captured by sensors 522 may be processed by software running upon processor 502 to determine characteristics of the user, e.g. gait, gesture performance data, or the like. In some embodiments, sensors 522 may also include physical output data, e.g. vibrations, pressures, and the like.

In some embodiments, a power supply 524 may be implemented with a battery (e.g. LiPo), ultracapacitor, or the like, that provides operating electrical power to device 500. In various embodiments, any number of power generation techniques may be utilized to supplement or even replace power supply 524, such as solar power, liquid metal power generation, thermoelectric engines, rf harvesting (e.g. NFC) or the like.

FIG. 5 is representative of one computing device 500 capable of embodying the present invention. It will be readily apparent to one of ordinary skill in the art that many other hardware and software configurations are suitable for use with the present invention. Embodiments of the present invention may include at least some but need not include all of the functional blocks illustrated in FIG. 5. For example, a smart phone configured to perform may of the functions described above includes most if not all of the illustrated functionality. As another example, a biometric acquisition device, e.g. a smart ring (electronic devices enclosed in a ring-shaped shell, enclosure, or form factor), may include some of the functional blocks in FIG. 5, it need not include a high-resolution display 530 or a touch screen, a speaker/microphone 560, wired interfaces 570, or the like. In still other examples, a cloud-based server or a virtual machine (VM) may not include image acquisition device 512, MEMs devices 522, GPS capability 516, and the like, further components described above may be distributed among multiple computers, virtual machines, or the like.

FIG. 6 illustrates a block diagram according to some embodiments of the present invention. More specifically, FIG. 6 illustrates a block diagram of a reader device 600 described herein and illustrated as reader 404 and 406 in FIG. 4. In some embodiments, device 600 includes an rf control module 602, a controller 604, memory 606, an accelerometer 608, visual/haptic output 610, audio output 612, antennas 614, interface bus 616, and an interface module 618.

In some embodiments, controller 604 may be embodied as a Nordic nRF52832 system on a chip, suitable for controlling Bluetooth Low Energy (BLE) communications and for performing various functionalities described herein. Controller 604 may include a processor, such as a 32-bit ARM® Cortex®-M4F CPU and include 512 kB to 64 kB RAM. In various embodiments, other types of SoC controllers may also be used, such as Blue Gecko from Silicon Labs, CC2508 from TI, or the like. Controller 602 may be embodied as a muRata 1LD Wi-Fi/BLE module, suitable for controlling Bluetooth low energy (BLE) and Wi-Fi communications. Controller 602 may include a processor, such as a 32-bit ARM® Cortex®-M4. In various embodiments, other types of controllers may also be used, such as CYW43012 from Cypress, or the like. In some embodiments, modules 602 and 604 enable communication via short range communications protocols, such as BLE, Zigbee, or the like. Modules 602 and 604 may also support mesh networking via BLE, Wi-Fi 6, or the like. In some embodiments, module 602 also supports Wi-Fi communications to communicate over a wide-area network (e.g. Internet).

In various embodiments, memory 606 may include non-volatile memory storing embodiments of the executable software code described herein. In some embodiments, the memory may be SRAM, Flash memory, or the like. In FIG. 6, audio/haptic output 612 is provided to give a visitor with audio feedback or haptic feedback and visual output 602 is provided to give a visitor visual feedback in response to the visitor approaching reader device 600. In some embodiments, visual output 602 may be one or more LED lights having different colored outputs, may be a status display panel. The feedback may be provided to the visitor based upon the visitor's security application running upon the smart device and interacting with reader device 600. For example, if the smart device does not have the proper credentials for reader device 600, a harsh buzzing sound may be played by audio output 610, and a red flashing light may be output by visual output 610; if the smart device is authenticated with reader device 600, a bell ding sound may be played and the text "OK" may be displayed on a display; if the smart device is not authenticated with reader device 600, an audio message and textual message may be output: "Not authenticated. For access, please call" or the like.

Accelerometer 628 is provided in some embodiments to determine whether reader device 600 is tampered with. For example, after installed and operable on a mounting location (e.g. on a wall), accelerometer 628 monitors the orientation of accelerometer 628 with respect to gravity. If a party attempts to remove reader device 600 from a mounting surface, accelerometer 628 will be able to sense the change in orientation. Based upon the change in orientation exceeding a threshold, a number of actions may be taken by reader device 600. One action may be to cease operation of reader device 600, another action may be to alert a remote server of the tampering, and the like.

In FIG. 6, interface 616 is used to couple reader device 600 to interface module 618. In various embodiments, interface module 618 interfaces with any number of external functional modules. In one configuration, an external functional module 620 may be a peripheral device under control, e.g. an electronically controlled door latch, a television, a vending machine, a computer, an electronic panel, an automobile, a kiosk or the like; in another configuration, external functional module 620 may be an existing module that is configured to read conventional low frequency or high frequency (LF/HF/UHF/etc.) based proximity cards or badges; and the like. In some embodiments, external reader module 620 may be an existing reader mounted upon a wall, or the like. In some embodiments, interface 616 may provide power to reader module 600, interface 616 may transmit data from reader device 600 to interface module 618 (e.g. credentials), provide power or the like.

In one configuration, rf control module 602 is not used, and only one BLE antenna 614 is provided; in another configuration, modules 602 and 604 are both used, and two BLE antennas 614 are used (one specifically for scanning for ephemeral IDs within a geographic region and one specifically for handling communications with a smart device). Such embodiments are particularly useful in high volume situations wherein one BLE antenna may receive ephemeral IDs from many different smart devices (e.g. 12 users walking down a hall near a security door or vending machine), whereas the other BLE antenna will provide the credentials and receive tokens from the specific users' smart phones who want to interact with the reader (e.g. to enter the security door, to receive a good, to access a computer or the like). In other embodiments, other channels may be used to provide the above communications, such as short-range Wi-Fi, Zigbee, NFC, ANT, or the like.

In still another configuration, additional modules 622 may be provided to add additional functionality to reader module 600. In some embodiments, module 622 may be an rf encoding module that converts data associated with the user (e.g. a badge number) into a format (e.g. LF/HF/UHF badge or tag) that is readable by a conventional RFID card or badge reader. In some embodiments, module 622 may include one or biometric capture devices that capture biometric data of a user associated with a smart device. In some embodiments, biometric data may include facial data, voice data, eye data (e.g. iris, retina, blood vessel), print data (e.g. fingerprints, palm print, blood vessel), movement data (e.g. signature, movement, gait), and the like that may be used to facilitate authentication of the visitor.

In some embodiments, reader module 600 may be configured to be a presence sensor, that does not necessarily interface with peripheral devices, e.g. 620. In such embodiments, only a single BLE transceiver may be used (e.g. 604 or 602) to broadcast its presence to smart devices in the vicinity and/or to scan for ephemeral IDs from such smart devices in the vicinity. In such embodiments, presence of smart devices may be monitored and logged within memory 606. Additionally, using WIFI, a mesh network (e.g. Bluetooth), using a smart device WAN, or the like, the presence of an ephemeral ID (e.g. smart devices) may be communicated to the security server 414, local access server 412, or the like.

Further embodiments can be envisioned to one of ordinary skill in the art after reading this disclosure. For example, embodiments may be applied to other security-based systems. For example, in an air travel security embodiment, if the passenger is booked for a 5 PM flight, a period of time the user may be authorized to pass through passport control may be from 2 PM until 4:45 PM, a period of time the user may be authorized to pass through security control may be from 2 PM until 4:30 PM, a period of time the user can check-in luggage may be from 1 PM until 4 PM, and the like. In various embodiments, a security-system will enforce the order of nodes in the linked-list and will not authorize to a subsequent node on the list, until the previous node has been reached by the user. For example, if the user attempts to request a token for a second node (access location), that token will not be issued unless the user's smart device has requested a token for a preceding first node (access location), as determined by a token issuing server (ignoring the time periods for sake of convenience). In another example, generally, if the user attempts to enter a secure access location associated with a second node, access will not be issued unless the user has entered a secure access location associated with a preceding first node, as determined by a back-end security-system server (ignoring the time periods for sake of convenience). Referring to the airport example above, if the user does not pass through passport control of the security-system, the security-system will not allow the user to proceed to security control.

In some embodiments, access server 412 may be used to enforce the specified ordering of access locations. In some embodiments, access server 412 may receive the linked list of nodes from cloud server 414 or scheduling server 416. In an example, the linked list may specify that the user device must access reader 404 (e.g. a ID check) before accessing reader 406 (e.g. boarding a vehicle). In operation, if user device 402 provides a valid token to reader 406, access server 412 will instruct peripheral device 410 to perform the desired action only if user device 402 has previously provided a valid token to reader 404. In the example above, if user device 402 skips the ID check, the user will not be able to board the vehicle.

In some embodiments where access server 412 may not be used, readers such as reader 404, 406 and the like may communicate with cloud server 414 to facilitate adherence to the ordering of access control points in the linked-list of nodes. In some embodiments, readers 404, 406 and the like may include WAN communication means (e.g. cellular, 4G, 5G, WIFI, etc.), and in other embodiments, readers 404, 406 and the like may include mesh-network capability. In such embodiments, readers communicate with each other in a mesh-network to ultimately communicate with cloud server 414. In some embodiments, reader 406 will not trigger peripheral device 410, upon request of user device 402, unless user device 402 has first interacted with reader 404. Some embodiments use cloud serve 414 to enforce this ordering.

Other embodiments may involve the control of access to assets other than geographical locations such as rooms. Accordingly, the linked list of nodes may refer to assets, such as computers, control panels, portable devices, and the like. As an example, a linked list of nodes may include: a lobby security door, an elevator control panel, a secure room door, and a company computer. In some embodiments, only if the security system detects that the user has passed through the lobby security door, used the elevator control panel, and passed through the secure room door, only then will the security system allow the user to login to the computer system. In some embodiments, time between the above events may be restricted. For example, the user has to pass through the secure room door no more than 15 minutes, as determined by the security system, prior to attempting to login. In some other embodiments, the nodes may be satisfied in any order, and in other embodiments, the nodes must be satisfied in the order specified by the linked list of nodes.

In other embodiments, additional types of actions may be included in a linked list of security nodes other than monitoring or providing a user access to access control points. These additional types of action may be appended to the linked list of nodes. One such action may include a security guard having the user pass through a metal detector, asking them questions, and providing their approval (e.g. waving on a user, allowing a user to pass, etc.). The security guard may indicate their approval to a security server (e.g. 414 or 412) via clicking on the user's name on a computer system linked thereto, or the like. In another example, an additional action maybe via authentication of a user identification (e.g. passport, driver's license, employee badge, etc.). In some examples, this may be performed at the security station manually (e.g. utilizing a UV light source) or by software running locally, or via SaaS, e.g. withpersona.com, UnifyID, or the like.

In other embodiments, combinations or sub-combinations of the above disclosed embodiments can be advantageously made. The block diagrams of the architecture and flow charts are grouped for ease of understanding. However, it should be understood that combinations of blocks, additions of new blocks, re-arrangement of blocks, and the like are contemplated in alternative embodiments of the present disclosure.

It is also understood that the examples and embodiments described herein are for illustrative purposes only and that various modifications or changes in light thereof will be suggested to persons skilled in the art and are to be included within the spirit and purview of this application and scope of the appended claims.

We claim:

1. A method for a security system comprising:

receiving via a first transceiver from a smart device a first identifier associated with a first access control point and a user identifier associated with a user of the smart device;

retrieving from a memory a first ordered list of nodes in response to the user identifier, wherein the first ordered list of nodes is associated with a first plurality of access control points;

determining in a processor whether the first access control point is within the first plurality of access control points;

determining a first token associated with the first access control point when the first access control point is within the first plurality of access control points; and providing via the first transceiver to the smart device the first token in response to the first access control point being within the first plurality of access control points;

wherein the first token is output from the smart device to cause the first access control point to become accessible to the user;

receiving via the first transceiver from the smart device a second identifier associated with a second access control point and the user identifier associated with the user of the smart device;

determining in the processor whether the second access control point is within the first plurality of access control points;

determining a second token associated with the second access control point when the second access control point is within the first plurality of access control points;

receiving via the first transceiver from the smart device an indication that the first token was successfully authenticated by the first access control point;

providing via the first transceiver to the smart device the second token in response to the second access control point being within the first plurality of access control points, and to the indication that the first token was successfully authenticated by the first access control point; and wherein the second token is output from the smart device to cause the second access control point to become accessible by the user.

2. The method of claim 1 wherein the determining the first token associated with the first access control point comprises digitally signing a message.

3. The method of claim 1 wherein the second access control point is selected from a group consisting of: a security door within a building, a security entry within a building, an elevator within a building, a check-in kiosk and a turnstile within a building.

4. The method of claim 1 wherein the second access control point is selected from a group consisting of: a laptop, a smart device, a tablet, an environmental control, and a computer.

5. The method of claim 1 further comprising:

wherein the first token is associated with a first time period;

wherein the second token is associated with a second time period; and wherein the first time period begins earlier than the second time period.

6. The method of claim 1 further comprising:

determining a plurality of tokens associated with a plurality of access control points when the first access control point is within the first plurality of access control points; and providing via the first transceiver to the smart device the plurality of tokens in response to the first access control point being within the first plurality of access control points.

7. The method of claim 1 further comprising:

directing via the first transceiver to the smart device to delete tokens associated with access control points within the first plurality of access control points stored within the smart device in response to the second access control point being within the first plurality of access control points.

8. A security system comprising:

a first transceiver configured to receive from a smart device a first identifier associated with a first access control point and a user identifier associated with a user of the smart device;

a memory configured to retrieve a first ordered list of nodes in response to the user identifier, wherein the first ordered list of nodes is associated with a first plurality of access control points;

a processor configured to determine whether the first access control point is within the first plurality of access control points, wherein the processor is configured to determine a first token associated with the first access control point when the first access control point is within the first plurality of access control points;

wherein the first transceiver is also configured to provide to the smart device the first token in response to the first access control point being within the first plurality of access control points;

wherein the first token is output from the smart device to cause the first access control point to become accessible to the user;

wherein the first transceiver is configured to receive from the smart device a second identifier associated with a second access control point and the user identifier associated with the user of the smart device;

wherein the processor is configured to determine whether the second access control point is within the first plurality of access control points;

wherein the processor is configured to determine a second token associated with the second access control point when the second access control point is within the first plurality of access control points;

wherein the first transceiver is configured to receive from the smart device an indication that the first token was successfully authenticated by the first access control point;

wherein the first transceiver is configured to provide to the smart device the second token is in response to the second access control point being within the first plurality of access control points, and to the indication that the first token was successfully authenticated by the first access control point; and wherein the second token is output from the smart device to cause the second access control point to be accessible to the user.

9. The system of claim 8 wherein the first transceiver is coupled to a wide-area-network.

10. The system of claim 8 wherein the second access control point is selected from a group consisting of: a security door within a building, a security entry within a building, an elevator within a building, a check-in kiosk and a turnstile within a building.

11. The system of claim 8 wherein the second access control point is selected from a group consisting of: a laptop, a smart device, a tablet, an environmental control, and a computer.

12. The system of claim 8 wherein the processor is configured to determine a plurality of tokens associated with a plurality of access control points when the first access control point is within the first plurality of access control points; and wherein the first transceiver is configured to provide to the smart device the plurality of tokens in response to the first access control point being within the first plurality of access control points.

13. The system of claim 8 wherein the first token is associated with a first time period;

wherein the second token is associated with a second time period; and wherein the first time period begins earlier than the second time period.

14. A method for a security system comprising:

receiving via a first transceiver from a smart device a first identifier associated with a first access control point and a user identifier associated with a user of the smart device;

retrieving from a memory a first ordered list of nodes in response to the user identifier, wherein the first ordered list of nodes is associated with a first plurality of access control points;

determining in a processor whether the first access control point is within the first plurality of access control points;

determining a first token associated with the first access control point when the first access control point is within the first plurality of access control points; and providing via the first transceiver to the smart device the first token in response to the first access control point being within the first plurality of access control points;

wherein the first token is output from the smart device to cause the first access control point to become accessible to the user;

receiving via the first transceiver from the smart device a second identifier associated with a second access control point and the user identifier associated with the user of the smart device;

determining in the processor whether the second access control point is within the first plurality of access control points;

determining a second token associated with the second access control point when the second access control point is within the first plurality of access control points;

directing via the first transceiver to the smart device to delete tokens associated with access control points within the first plurality of access control points stored within the smart device in response to the second access control point being within the first plurality of access control points; and providing via the first transceiver to the smart device the second token in response to the second access control point being within the first plurality of access control points.

15. The method of claim 14 wherein the determining the first token associated with the first access control point comprises digitally signing a message.

16. The method of claim 14 wherein the second access control point is selected from a group consisting of: a security door within a building, a security entry within a building, an elevator within a building, a check-in kiosk and a turnstile within a building.

17. The method of claim 14 wherein the second access control point is selected from a group consisting of: a laptop, a smart device, a tablet, an environmental control, and a computer.

18. The method of claim 14 further comprising:

receiving via the first transceiver from the smart device an indication that the first token was successfully authenticated by the first access control point; and wherein the providing via the first transceiver to the smart device the second token is in response to the second access control point being within the first plurality of access control points, and to the indication that the first token was successfully authenticated by the first access control point.

19. The method of claim 14 further comprising:

determining a plurality of tokens associated with a plurality of access control points when the first access control point is within the first plurality of access control points; and providing via the first transceiver to the smart device the plurality of tokens in response to the first access control point being within the first plurality of access control points.

20. The method of claim 14 wherein the first token is associated with a first time period;

wherein the second token is associated with a second time period; and wherein the first time period begins earlier than the second time period.

* * * * *